US010249454B2

(12) United States Patent
Muller

(10) Patent No.: US 10,249,454 B2
(45) Date of Patent: Apr. 2, 2019

(54) KEY STEM FOR A KEY MODULE OF A KEY FOR A KEYBOARD, KEY MODULE OF A KEY FOR A KEYBOARD, AND METHOD FOR MANUFACTURING A KEY MODULE FOR A KEY FOR A KEYBOARD

(71) Applicant: ZF Friedrichshafen AG, Friedrichshafen (DE)

(72) Inventor: Karl-Heinz Muller, Auerbach (DE)

( * ) Notice: Subject to any disclaimer, the term of this patent is extended or adjusted under 35 U.S.C. 154(b) by 0 days.

(21) Appl. No.: 14/780,366

(22) PCT Filed: Feb. 28, 2014

(86) PCT No.: PCT/EP2014/053894
§ 371 (c)(1),
(2) Date: Sep. 25, 2015

(87) PCT Pub. No.: WO2014/154438
PCT Pub. Date: Oct. 2, 2014

(65) Prior Publication Data

US 2016/0049264 A1 Feb. 18, 2016

(30) Foreign Application Priority Data

Mar. 28, 2013 (DE) ..... 10 2013 205 580

(51) Int. Cl.
*H01H 13/70* (2006.01)
*H01H 13/14* (2006.01)
(Continued)

(52) U.S. Cl.
CPC ..... *H01H 13/14* (2013.01); *H01H 11/00* (2013.01); *H01H 13/02* (2013.01); *H01H 13/20* (2013.01); *H01H 2237/006* (2013.01)

(58) Field of Classification Search
CPC ..... H01H 13/14; H01H 13/02; H01H 11/00; H01H 13/20; H01H 2237/006
(Continued)

(56) References Cited

U.S. PATENT DOCUMENTS 5,201,824 A * 4/1993 Kato ..... H01H 13/705 200/341
5,310,973 A * 5/1994 Lee ..... H01H 13/70 200/345
2004/0182688 A1 9/2004 Komoto

FOREIGN PATENT DOCUMENTS

DE 3447085 A1 7/1986
DE 3742711 A1 7/1989
(Continued)

OTHER PUBLICATIONS

International Search Report issued Jun. 2, 2014 in International Application No. PCT/EP2014/053894 (English language of pp. 3-5, 3 pages).
(Continued)

*Primary Examiner* — Edwin A. Leon
*Assistant Examiner* — Lheiren Mae A Caroc

(57) ABSTRACT

A key stem for a key module of a key for a keyboard is proposed. The key stem has a coupling section for coupling a key button thereto, and a guidance section for guiding a key stem into a receiving section of the key module when the key stem is actuated between a standby position and an actuation position. The key stem is includes at least one elastically deformable end stop element, which is disposed on the guidance section and is designed to bear against at least one end stop section of the key module when the key stem is actuated into the actuation position. The key stem also includes at least one elastically deformable return stop element, which is disposed on the guidance section and is designed to bear against at least one return stop section of
(Continued)

the key module when the key stem has been actuated back into the standby position.

18 Claims, 4 Drawing Sheets

(51) Int. Cl.
*H01H 13/20* (2006.01)
*H01H 11/00* (2006.01)
*H01H 13/02* (2006.01)

(58) Field of Classification Search
USPC ..... 200/341, 344, 345
See application file for complete search history.

(56) References Cited

FOREIGN PATENT DOCUMENTS

| | | | |
|---|---|---|---|
| DE | 19951556 | B4 | 3/2005 |
| EP | 0100936 | B1 | 6/1989 |
| EP | 0461283 | A1 | 12/1991 |
| GB | 2229861 | A | 10/1990 |
| GB | 2233500 | A | 1/1991 |
| WO | WO 03-062569 | A1 | 7/2003 |
| WO | WO 2011-004318 | A1 | 1/2011 |

OTHER PUBLICATIONS

International Search Report and Written Opinion issued Jun. 2, 2014 in International Application No. PCT/EP2014/053894 (German language, 11 pages).

Search Report dated Aug. 8, 2013 for German Patent Application No. DE 10 2013 205 580.3 (German language, 5 pages).

Translation of p. 5 of Search Report dated Aug. 8, 2013 in German Patent Application No. DE 10 2013 205 580.3 (2 pages).

* cited by examiner

KEY STEM FOR A KEY MODULE OF A KEY FOR A KEYBOARD, KEY MODULE OF A KEY FOR A KEYBOARD, AND METHOD FOR MANUFACTURING A KEY MODULE FOR A KEY FOR A KEYBOARD

RELATED APPLICATIONS

This application is a filing under 35 U.S.C. § 371 of International Patent Application PCT/EP2014/053894, filed Feb. 28, 2014, and claims the priority of German Patent Application DE 10 2013 205 580.3, filed Mar. 28, 2013, both of which are incorporated by reference herein in their entirety.

BACKGROUND

1. Technical Field

The present invention relates to a key stem for a key module of a key for a keyboard, to a key module of a key for a keyboard, and to a method for manufacturing a key module for a key for a keyboard.

2. Background Information

Individual parts of a key module of a key of a keyboard, in particular parts for a guidance of a key stem, are usually made of plastic. When the key is actuated, two, normally hard plastic surfaces, for example, strike one another at an end stop. When returned to a starting position, two, normally hard plastic surfaces, for example, likewise strike one another.

EP 0 100 936 B1 discloses a key switch having at least one stationary contact piece in a base and a U-shaped curved contact mechanism, the contact-side end of which can be pivoted in a spring-loaded manner from one switching position to another switching position by means of at least one key cam of a key stem supported on a return spring.

BRIEF SUMMARY OF THE INVENTION

Based on this background, the present invention provides an improved key stem for a key module of a key for a keyboard, an improved key module of a key for a keyboard, and an improved method for manufacturing a key module for a key for a keyboard, in accordance with the independent Claims. Advantageous designs can be derived from the dependent Claims and the following description.

According to embodiments of the present invention, a key stem for a key module of a key for a keyboard can be designed such that the key stem has two material components. In particular, a key module is provided, in particular an MX module, having a key stem made of plastic, with rubber elements integrated therein, or that can be integrated therein. The key stem can, for example, have a hard material component, or sections made of a hard material and a soft material component, or sections made of a soft material. The sections made of the soft material on the key stem can end up thereby, in particular in the event of a key actuation, in contact with surfaces of the key module made of a hard material, at both end points, or reverse motion points, of a key movement.

Advantageously, according to embodiments of the present invention, a key module can be created that, by using such a key stem, when a key is actuated, in particular, the key module makes a reduced noise, or low noise. A noise reduction can be achieved thereby in the actuation and return of the key. Conveniently, in particular merely, modifications to the noise reduced key stem need be made thereby, wherein the remaining individual parts of the key module can be standard stock. As a result, it is possible to use an existing model of a key module with minor modifications. Merely by means of minor changes to individual parts of the key module, or merely minor changes in the production of a module, a noise reduction can be achieved. Thus, a standard module assembly, in particular a standard MX module assembly, e.g. a printed circuit board assembly or frame assembly, can be obtained. Furthermore, even with production facilities or, in particular, MX production robots, merely a minor change to a key stem supply need be made in order to produce the noise reduced key module. Further standard characteristics of the key module, e.g. an MX module, remain, advantageously, unchanged.

A particularly advantageous key stem for a key module of a key for a keyboard has a coupling section for coupling a key button thereto, and a guidance section for guiding the key stem into a receiving section of the key module when the key stem is actuated between a standby position and an actuation position, and is characterized by at least one elastically deformable end stop element, which is disposed on the guidance section, and is designed to bear against at least one end stop section of the key module when the key stem has been actuated into the actuation position, and at least one elastically deformable return stop element, which is disposed on the guidance section, and is designed to bear against at least one return stop section of the key module when the key stem has been actuated back into the standby position.

A keyboard can have at least one key, wherein one key module is provided for each key. A key can exhibit the key module, or can be formed by the key module. The key module can, for example, be a so-called MX module or suchlike. By using, or incorporating, respectively, the aforementioned key module in a keyboard, a noise reduction can be obtained when the key is actuated. The key button can represent a visible and operable, by pressing downward thereon, part of the key module for an operator. The coupling section of the key stem can be mechanically coupled to the key button. In an assembled state of the key module, the guidance section of the key stem can be received, at least in part, in the receiving section of the key module, such that is can move along an actuating axis, or the longitudinal axis of the key stem. The standby position of the key stem, or the key module, respectively, or the key, can correspond to a state of the key when it is not pressed down. The actuation position of the key stem, or the key module, respectively, or the key, can correspond to a position of the key when it is pressed down.

According to one embodiment, a material for the at least one end stop element can have a lower hardness than a material for the guidance section. Moreover, a material for the at least one return stop element can have a lower hardness than the material for the guidance section. Furthermore, the material for the at least one end stop element and the material for the at least one return stop element can have a lower hardness than a material for the receiving section of the key module, in particular the end stop section as well as the return stop section. An embodiment of this type offers the advantage that when such an end stop element and such a return stop element arrive at the guidance section, noise development can be reduced.

In particular, the at least one end stop element can have a rubber lip. Likewise, the at least one return stop element can also have a rubber lip. The at least one end stop element and the at least one return stop element can be made of rubber or an elastically deformable plastic. An embodiment of this type offers the advantage that a noise reduction can be improved and wear to the elements can be reduced by means of such an end stop element and such a return stop element.

The at least one end stop element can also be disposed in a first end region of the guidance section, facing away from the coupling section. Furthermore, the at least one return stop element can be disposed in a second end region of the guidance section, facing toward the coupling section. The at least one end stop element can come in contact thereby with the end stop section of the key module when the key is pressed down, in order to form an end stop for a key actuation. Furthermore, the at least one return stop element can come in contact with the return stop section of the key module when the key is released, in order to form a standby position stop for the key actuation. An embodiment of this type offers the advantage that well defined, noise reduced, or low-noise key stops can be created.

Furthermore, an actuation path of the key stem, between the standby position and the actuation position, can be a function of a thickness dimension of the at least one end stop element along an actuation axis of the key stem and of a thickness dimension of the at least one return stop element along an actuation axis of the key stem. Reversal points, or end points of a movement of the key stem in the receiving section of the key module when the key has been actuated can be a function of the thickness dimension of the at least one end stop element and the thickness dimension of the at least one return stop element. By way of example, an enlargement of at least one of the thickness dimensions can result in a shortening of the actuation path, and, alternatively, a reduction of at least one of the thickness dimensions can result in a lengthening of the actuation path. The actuation path between one position of a mechanical contact between the end stop element and the end stop section and a position of a mechanical contact between the return stop element and the return stop section is a function of the thickness dimension. An embodiment of this type offers the advantage that the actuation path, and potentially, a switching point of a key module, can be embodied such that it can be varied by means of an embodiment of the thickness dimensions of the elements, or soft components, respectively. The actuation path, and potentially the switching point, can be affected by a selection of elements having appropriate thickness dimensions, depending on the intended use. Insertion sections disposed on the guidance section of the key stem can be formed thereby for an attachment of the at least one end stop element, as well as the at least one return stop element, having play, or tolerance, for receiving elements having different thickness dimensions.

In addition, numerous elastically deformable rocker stop elements may be provided, which are disposed on the guidance section and are designed to bear against the receiving section of the key module when the key step has been actuated into the actuation position such that the key stem tilts in relation to the key module. An embodiment of this type offers the advantage that a tilting of the guidance stem in relation to the actuation axis when in the actuation position can be corrected.

The numerous rocker stop elements can be disposed thereby, such that they are adjacent to the at least one end stop element. Additionally or alternatively, the numerous rocker stop elements can be formed as an integral part of the at least one end stop element. An embodiment of this type offers the advantage that an equipping of the key stem with the at least one end stop element and the numerous rocker stop elements can be simplified, in particular when the end stop element and the rocker stop elements are combined in a single component.

According to one embodiment, two return stop elements, two end stop elements and two pairs of rocker stop elements may be provided. A first of the end stop elements can be disposed thereby between a first pair of rocker stop elements. Moreover, a second of the end stop elements can be disposed between a second pair of rocker stop elements. In particular, the first of the end stop elements and the first pair of rocker stop elements can be designed as a first integrated component, and the second of the end stop elements and the second pair of rocker stop elements can be designed as a second integrated component. An embodiment of this type offers the advantage that both a noise reduction as well as a protection against tilting can be achieved for a key module by means of a key stem of this type.

A particularly advantageous key module of a key for a keyboard has a key button and a receiving section for receiving a key stem, characterized in that the key module has a version of the key stem specified above, wherein the guidance section of the key stem is received in the receiving section of the key module.

A version or variation of the key stem described above can be advantageously implemented, or used, in conjunction with the key module in order to obtain a noise reduction in the key module.

A particularly advantageous method for manufacturing a key module of a key for a keyboard has the following steps: provision of a key module, having a key button and a receiving section for receiving a key stem, and a key stem as described above; and positioning of the guidance section of the key stem in the receiving section of the key module, such that at least one end stop element of the key stem is disposed between the guidance section of the key stem and the at least one end stop section of the key module, and the at least one return stop element of the key stem is disposed between the guidance section of the key stem and the at least one return stop section of the key module.

The method, in conjunction with a key stem or key module such as is described above, results in advantageous noise reduction.

BRIEF DESCRIPTION OF THE DRAWINGS

The invention shall be explained in greater detail based on the attached drawings. Therein.

DETAILED DESCRIPTION OF THE PREFERRED EMBODIMENTS

In the following description of preferred exemplary embodiments of the present invention, identical or similar reference symbols are used for the elements depicted in the various figures and elements having similar functions, wherein a description of these elements shall not be repeated.

Figure 1:
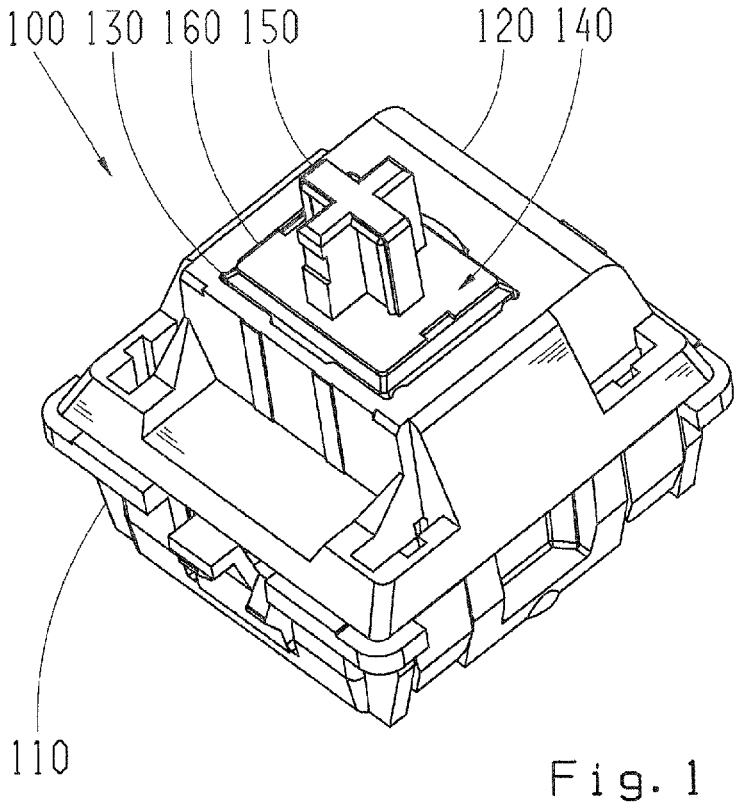
FIG. 1 shows a key module according to an exemplary embodiment.

FIG. 1 shows a perspective view of a key module 100 according to an exemplary embodiment. The key module 100 has a module base 110, a module cover 120, a receiving section 130 and a key stem 140 having a coupling section 150 and a guidance section 160. The key module 100 is a part of a key for a keyboard, for example. The key stem 140 is, by way of example, the key stem shown in FIG. 2.

The module base 110 and the module cover 120 are coupled to one another. The module base 110 and the module cover 120 form a main body of the key module thereby. The receiving section 130 of the key module 100 is designed as a shaft, which extends, starting from the module cover 120, through a portion of the main body of the key module 100.

The key module 140 is partially received in the receiving section 130. The coupling section 150 is disposed, up to the key stem 140, outside of the main body of the key module 100 thereby. The coupling section 150 is designed to enable a coupling of a key button thereto. The guidance section 160 of the key stem 140 is at least partially received in the receiving section 130 of the key module 100 thereby.

When actuated, the key stem 140 can move in relation to the main body of the key module 100 formed by the module base 110 and the module cover 120. Even when it is not explicitly visible in FIG. 1, an actuation axis of the key stem 140, along which the key stem 140 can move when actuated, extends along a longitudinal axis of the receiving section 130 of the key module 100.

Figure 2:
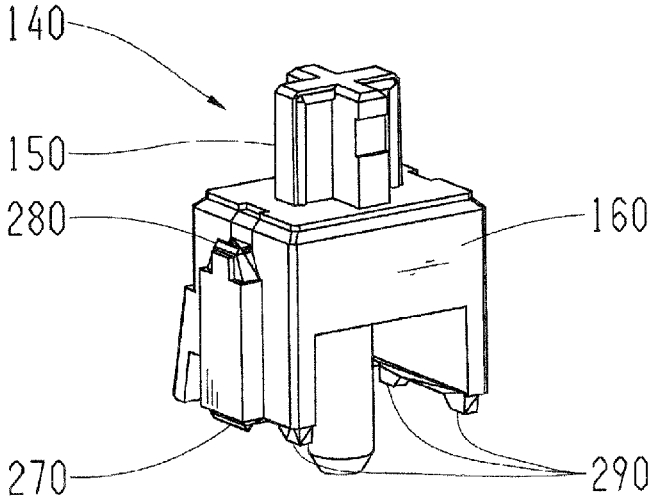
FIG. 2 shows a key stem according to an exemplary embodiment.

FIG. 2 shows a perspective view of a key stem 140 according to an exemplary embodiment. The key stem 140 is, by way of example, the key stem of the key module in FIG. 1. The key stem 140 has a coupling section 150, a guidance section 160, two, by way of example, end stop elements 270, of which only one is shown, due to the nature of the illustration, two, by way of example, return stop elements 280, of which only one is shown, due to the nature of the illustration, and four, by way of example, rocker stop elements 290, of which only three are shown, due to the nature of the illustration.

Except for the end stop elements 270, the return stop elements 280 and the rocker stop elements 290, the key stem 140 is made, by way of example, from a hard plastic material. The end stop elements 270 are made, by way of example, from rubber or suchlike, and moreover, preferably as a single integrated component, or alternatively, from two integrated components.

The key stem 140 has a rectangular base surface, starting from which the coupling section 150 extends in a first direction, and the guidance section 160 extends in a second direction, opposite the first direction. The coupling section 150 has a circular outline, and is extruded from the base surface in the first direction. The guidance section 160 has a box-shaped outer section, extruded in the second direction, having four lateral walls and a cylindrical inner section extruded in the second direction, encompassed at least in part by the outer section.

The guidance section 160 has a first end region, facing away from the coupling section 150 and the base surface. The guidance section 160 also has a second end region, facing the coupling section 150 and adjacent to the base surface. The end stop elements 270, the return stop elements 280 and the rocker stop elements 290 are disposed on the guidance section 160. The end stop elements 270 and the rocker stop elements 290 are disposed thereby in the first end region of the guidance section 160. The return stop elements 280 are disposed in the second end region of the guidance section 160.

A first of the end stop elements 270 is disposed between a first pair of the rocker stop elements 290. The first of the end stop elements 270 and the first pair of rocker stop elements 290 are designed as a first integrated component thereby. Furthermore, a second of the end stop elements 270 is disposed between a second pair of rocker stop elements 290. The second end stop element 270 and the second pair of rocker stop elements 290, by way of example, are designed as a second integrated component thereby. Alternatively, the first and second end stop elements 270, together with the return stop elements 280 and the first and second rocker stop elements 290, can be designed as a single, integral component.

The first of the end stop elements 270 and the first pair of rocker stop elements 290 as well as a first of the return stop elements 280 are disposed on a first side wall of the outer section in the first end region of the guidance section 160. The second end stop element 270 and the second pair of rocker stop elements 290, as well as a second of the return stop elements 280 are disposed on a second side wall, lying opposite the first side wall, of the outer section in the second end region of the guidance section 160.

Expressed differently, the key stem 140, or the guidance stem, respectively, has a two-component bond between a hard material and a soft material. Thus, the coupling section 150 and the guidance section 160 are made of a plastic material. The end stop elements 270 are rubber lips for noise reduction at an end stop of the key stem 140 in a receiving section of a key module, e.g. the key module from FIG. 1, in an actuation position of the key stem 140 with respect to the key module. The return stop elements 280 are rubber lips for noise reduction at an end stop of the key stem 140 in a receiving region of a key module, e.g. the key module from FIG. 1, when the key stem 140 is returned to a standby position with respect to the key module. Furthermore, the rocker stop elements 290 are rubber elements, or stop surfaces for preventing a lateral tipping of the key stem 140 in the key module. In FIG. 2, the key stem 140, or an MX key stem, respectively, is depicted with integrated soft components in the design of the end stop elements 270, return stop elements 280 and rocker stop elements 290. These soft components are positioned such that a mechanical end stop during an actuation and a return are cushioned and buffered by the soft rubber elements. The key stem 140 can be used in particular in conjunction with a standard key module or standard module parts.

Figure 3A:
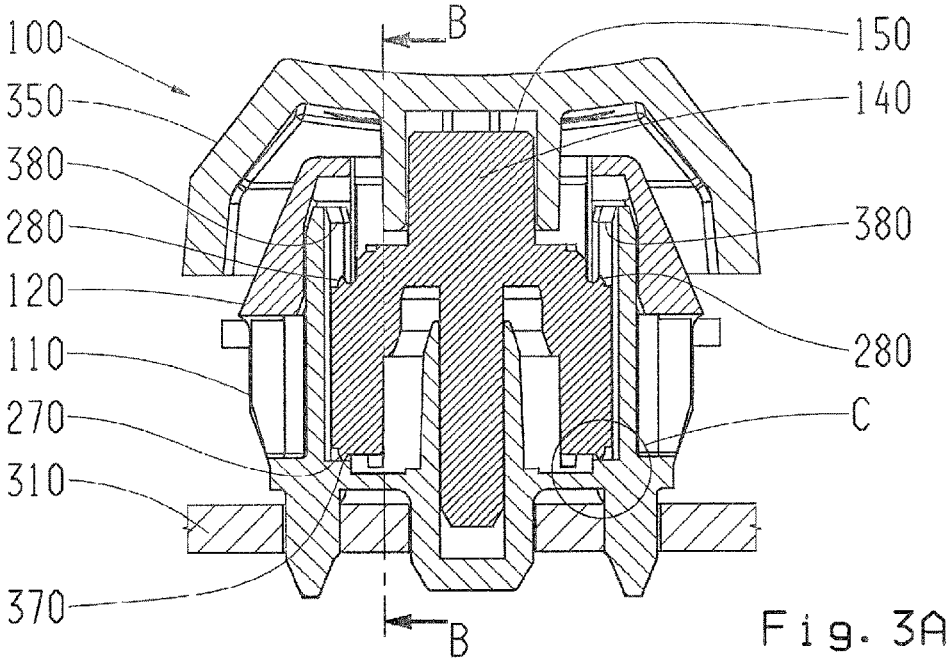
FIGS. 3A to 3C show a key module according to an exemplary embodiment in an actuated state.

FIG. 3A shows a sectional depiction of a key module 100 according to one exemplary embodiment, in an actuated state. Shown are the key module 100, a module base 110, a module cover 120, a key stem 140, a coupling section 150, by way of example two end stop elements 270, by way of example two return stop elements 280, a support element 310, a key button 350, by way of example two end stop sections 370 and, by way of example, two return stop sections 380. Furthermore, a sectional line B-B and a detail section C are shown in FIG. 3A. The detail section C comprises a region of one of the end stop elements 270 and one of the end stop sections 370. The key module 100 depicted in FIG. 3A corresponds to the key module shown in FIG. 1 thereby, with the exception that in FIG. 3A the support element 310 and the key button 350 are also provided. The key stem 140 is the key stem from FIG. 2.

The key module 100 has a module base 110, the module cover 120, the key stem 140 having the coupling section 150, the end stop elements 270, the return stop elements 280, the key button 350, the end stop sections 370 and the return stop sections 380. The key module 100 is mounted on the support element 310. The support element 310 is a printed circuit board, for example. The key button 350 is coupled to the coupling section 150 of the key stem 140.

The module base 110 and the module cover 120 have a receiving section for receiving the key stem 140. The end stop sections 370 and the return stop sections 380 are formed in the receiving section of the module base 110 and the module cover 120. The end stop sections 370 are formed in accordance with the exemplary embodiment of the present invention depicted in FIG. 3A, in a region of a module floor on which the key module 100 is connected to the support element 310. In particular, the end stop sections 370 are formed as partial sections of the module base 110. The return stop sections 380 are disposed thereby along an actuation axis of the key stem 140 inside the receiving section of the module base 110 and the module cover 120, spaced apart from the region of the module floor. The end stop sections 370 are disposed thereby between the module floor and the return stop sections 380. In particular, the return stop sections 380 are formed as partial sections of the module cover 120.

A first of the end stop sections 370 is disposed and designed thereby to function as a bearing surface for a first of the end stop elements 270. Furthermore, a second of the end stop sections 370 is disposed and designed to function as a bearing surface for a second of the end stop elements 270. The end stop sections 370 can also be formed as a joint end stop section 370.

A first of the return stop sections 380 is disposed and designed to function as a bearing surface for a first of the return stop elements 280, and a second of the return stop sections 380 is disposed and designed to function as a bearing surface for a second of the return stop elements 280. The return stop sections 380 can also be formed as a joint return stop section 380.

In the actuated state of the key module 100, the key stem 140 is moved into the receiving section of the module base 110 and the module cover 120 by means of an actuating force caused by a pressing of the key. The end stop elements 270 are located thereby bearing against an end stop section 370. Furthermore, the return stop elements 280 are disposed at a spacing to the return stop sections 380.

Figure 3B:
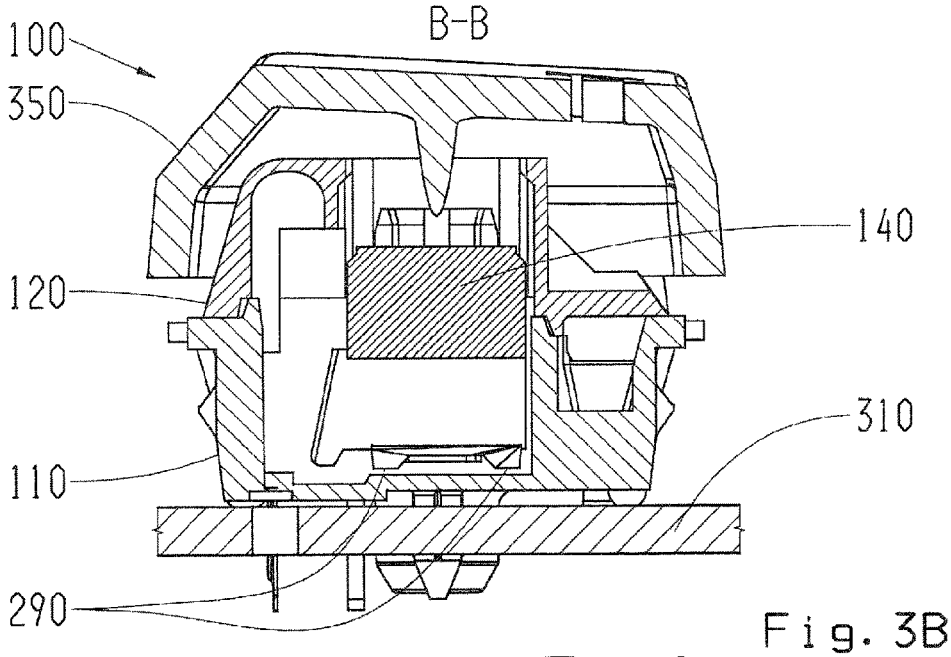

FIG. 3B shows a sectional depiction of the key module 110 from FIG. 3A along the sectional line B-B. Shown are the module base 110, the module cover 120, the key stem 140, by way of example, and restricted by the nature of the depiction, two rocker stop elements 290, the support element 310 and the key button 350. The rocker stop elements 290 are depicted in FIG. 3B, due to the rotated perspective with respect to FIG. 3A. In the actuated state of the key module 100, the rocker stop elements 290 are disposed in the region of the module floor in the receiving section. The rocker stop elements 290 are disposed thereby at a spacing to a floor wall of the receiving section by a tilting distance. The tilting distance is designed and sized in order to enable a mechanical contact between a rocker stop element 290 and the floor wall of the receiving section when the key stem 140 is tilted in relation the receiving section, or the module base 110, respectively, as well as the module cover 120, in order to limit or reduce the tilting due to the contact. The rocker stop elements 290 are rubber elements, for example, functioning as stopping surfaces in the event of a lateral tipping of the key stem 140 in the receiving section.

Figure 3C:
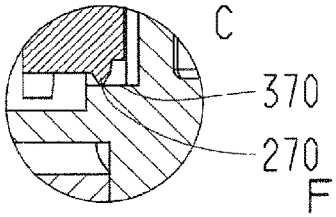

FIG. 3C shows the detail section C of the key module 100 from FIG. 3A. Shown are one of the end stop elements 270 and one of the end stop sections 370. Illustrated in the detail section in FIG. 3C is that, in the actuated state of the key module 100, the end stop element 270 is disposed such that it bears against the end stop section 370. The end stop element 270 is formed, for example, as a rubber lip for noise reduction at the end stop section 370. Depending on the design of the dimensions for the end stop element 270, an entire path for an actuation of the key module can be thus be set.

Thus, in FIGS. 3A to 3C, sections through a complete key module 100, or an MX module, and a key button 350, and a detail view in the actuated, or pressed down state, are shown, wherein the end stop elements 270 are located, as stop surfaces for the key stem 140, bearing against the end stop sections 370 on the base floor.

Figure 4A:
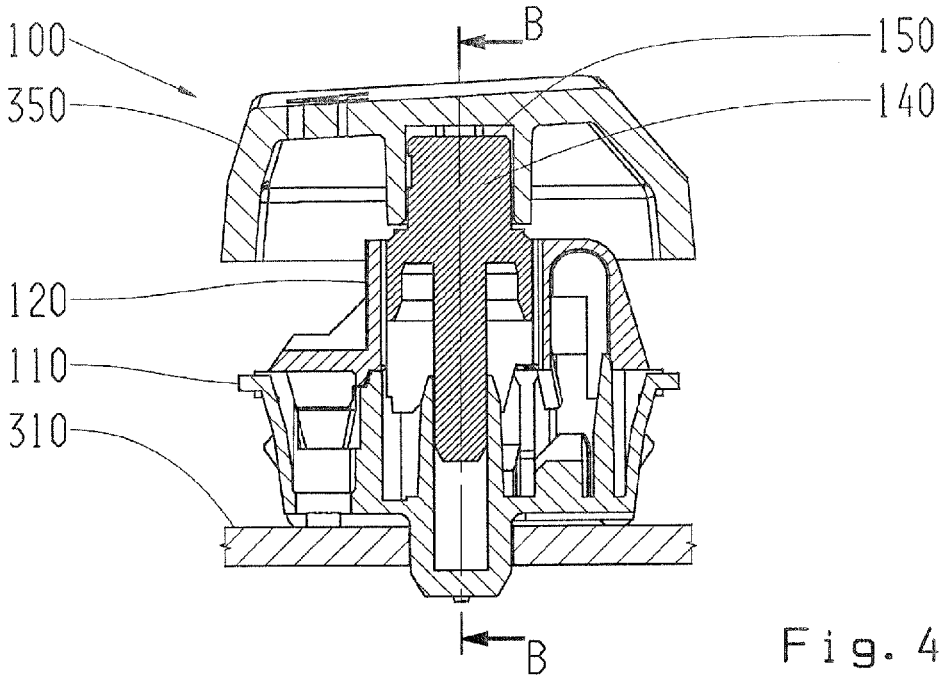
FIGS. 4*a* to 4C show a key module according to an exemplary embodiment when not actuated.

FIG. 4A shows a sectional depiction of a key module 100 according to an exemplary embodiment, in an un-actuated state. Shown are a key base 110, a key cover 120, a key stem 140 having a coupling section 150, a support element 310 and a key button 350. Furthermore, a sectional line B-B is shown in FIG. 4A. The sectional line B-B runs thereby through a module center of the key module 100, along a longitudinal axis of the key stem 140 when the key button 350 is not actuated. The sectional line B-B runs along an actuation axis of the key stem 140 thereby. The key module 100 depicted in FIG. 4A corresponds to the key module shown in FIG. 1 thereby, with the exception that in FIG. 4A, the support element 310 and the key button 350 are also provided. The key stem 150 is the key stem from FIG. 2. Thus, the key module 100 depicted in FIG. 4A corresponds to the key module shown in FIGS. 3A to 3C, with the exception that in FIG. 4A, the key module 100 is depicted in the un-actuated state. The view in FIG. 4A corresponds to the view in FIG. 3B thereby, with the exception that another cutting plane is selected, and the un-actuated state of the key module 100 is depicted.

Figure 4B:
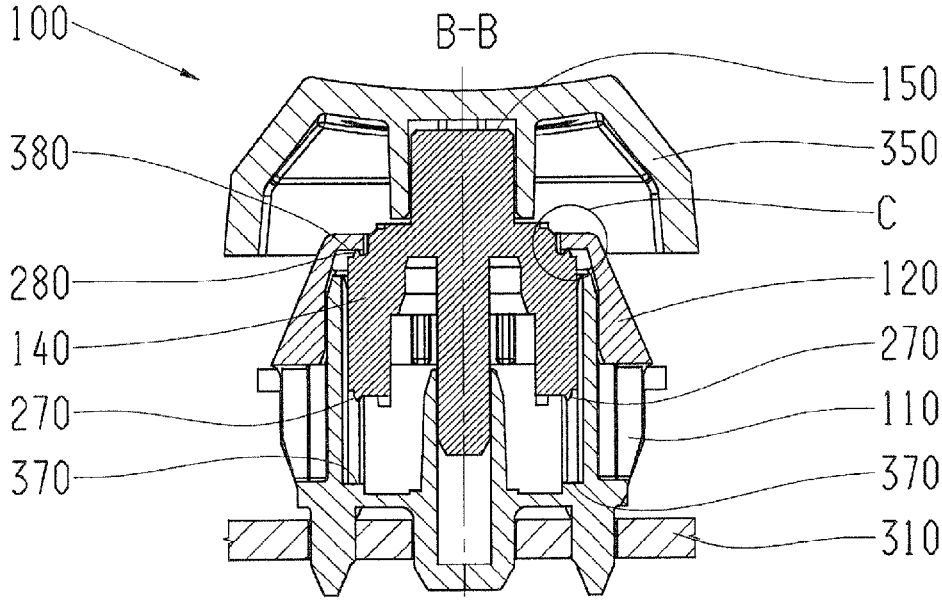

FIG. 4B shows a sectional depiction of the key module 100 from FIG. 4A, cut along the sectional line B-B. Shown thereby are the module base 110, which is, by way of example, a standard module base, the module cover 120, which is, by way of example, a standard module cover, the key stem 140 having the coupling section 150, by way of example two end stop elements 270, by way of example two return stop elements 280, the support element 310, the key button 350, which is, for example, a standard key button, by way of example two end stop sections 370 and by way of example two return stop sections 380. Furthermore, a detail section C in a region of one of the return stop elements 280 and one of the return stop sections are illustrated. The view in FIG. 4B corresponds thereby to the view from FIG. 3A, with the exception that the un-actuated state of the key module 100 is depicted.

In the un-actuated state of the key module 100 depicted in FIG. 4B, without pressing on the key, or actuating the key, the key stem 140 is disposed in a standby position in relation to the receiving section of the module base 110 and the module cover 120. The return stop elements 280 bear against the return stop sections 380 thereby. Furthermore, the end stop elements 270 are disposed at a spacing to the end stop sections 370.

Figure 4C:
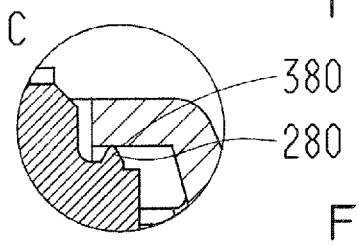

FIG. 4C shows the detail section C of the key module 100 from FIG. 4B. Shown are one of the return stop elements 280 and one of the return stop sections 380. Depicted in the detail section in FIG. 4C is that, in the un-actuated state of the key module 100, the return stop element 280 is disposed bearing against the return stop section 380. The return stop element 280 is formed, for example, as a rubber lip for noise reduction during a return stroke of the key module 100. Depending on the design for the dimensions of the return stop element 280, a path to a switching point during an actuation of the key module can thus be set.

Thus, sections through a complete key module 100, or an MX module, and a key button 350 and a detail view in an un-actuated state are shown in FIGS. 4A to 4C, wherein the return elements 280 are located as stop surfaces for the key stem 140, bearing against the return stop sections 380 on an inner surface of the module cover 120.

With reference to FIGS. 1 to 4C, in summary it is the case that the key stem 140 can move between an actuation position shown in FIGS. 3A to 3C, in the actuated state of the key module 100, in which the end stop elements 270 are located bearing against the end stop sections 370, and a standby position shown in FIGS. 4A to 4C, in the un-actuated state of the key module 100, in which the return stop elements 280 are located bearing against the return stop sections 380. The key stem 140 is, in accordance with the exemplary embodiments of the present invention depicted in FIGS. 1 to 4C, a two-component stem having rubber elements in the form of the end stop elements 270 and the return stop elements 280 for noise reduction at the end stop, and during the return movement of a key actuation.

Figure 5:
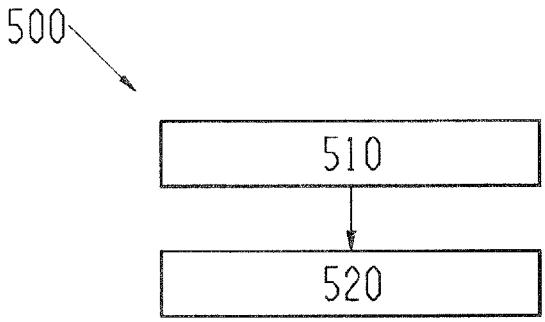
FIG. 5 shows a flow chart for a method according to an exemplary embodiment.

FIG. 5 shows a flow chart for a method 500 for manufacturing a key module of a key for a keyboard, according to the exemplary embodiment of the present invention. The method 500 has a step 510 for providing a key module, which has a key button and a receiving section for receiving a key stem, and a key stem. The key module is a key module such as one of the key modules from one of the FIGS. 1 and 3A to 4C. The key stem is a key stem such as one of the key stems from one of the FIGS. 1 to 4C. The method 500 also has a step 520 for positioning the guidance section of the key stem in the receiving section of the key module, such that at least one end stop element of the key stem is disposed between the guidance section of the key stem and the at least one end stop section of the key module, and the at least one return stop element of the key stem is disposed between guidance section of the key stem and the at least one return stop section of the key module. By executing the method 500, a key module such as one of the key modules from one of the FIGS. 1 and 3A to 4C can advantageously be manufactured.

The exemplary embodiments described herein and shown in the figures are selected only by way of example. Different exemplary embodiments can be combined with one another, either entirely or with respect to individual features. Furthermore, one exemplary embodiment can be supplemented by features of another exemplary embodiment. Steps of the described method can be repeated.

REFERENCE SYMBOLS

100 key module
110 module base
120 module cover
130 receiving section
140 key stem
150 coupling section
160 guidance section
270 end stop element
280 return stop element
290 rocker stop element
310 support element
350 key button
370 end stop section
380 return stop section
500 method for manufacturing
510 step for providing
520 step for positioning

What is claimed is:

1. A key stem for a key module of a key for a keyboard comprising:

a coupling section for coupling a key button thereto;

a guidance section for guiding the key stem into a receiving section of the key module when the key stem is actuated between a standby position and an actuation position;

at least one elastically deformable end stop element, which is disposed on the guidance section and is designed to bear against at least one end stop section of the key module when the key stem is actuated into the actuation position;

at least one elastically deformable return stop element, which is disposed in the guidance section and is designed to bear against at least one return stop section of the key module when the key stem is actuated back to the standby position; and wherein the key stem comprises a material for the at least one end stop element having a lower hardness than a material for the guidance section, and a material for the at least one return stop element having a lower hardness than the material for the guidance section.

2. The key stem according to claim 1, wherein the at least one end stop element comprises a rubber lip, and the at least one return stop element comprises a rubber lip.

3. The key stem according to claim 1, wherein the at least one end stop element is disposed in a first end region of the guidance section, facing away from the coupling section, and the at least one return stop element is disposed in a second end region of the guidance section, facing toward the coupling section.

4. The key stem according to claim 1, further comprising an actuation path for the key stem between the standby position and the actuation position, wherein the actuation path is a function of a thickness dimension of the at least one end stop element along an actuation axis of the key stem and a thickness dimension of the at least one return stop element along an actuation axis of the key stem.

5. The key stem according to claim 1, further comprising a plurality of elastically deformable rocker stop elements, which are disposed on the guidance section and designed to bear against the receiving section of the key module when the key stem is actuated into the actuation position with a tilting actuation of the key stem with respect to the key module.

6. The key stem according to claim 5, wherein the plurality of rocker stop elements are adjacent to the at least one end stop element and/or are an integral part of the at least one end stop element.

7. The key stem according to claim 5, further comprising two return stop elements, two end stop elements and two pairs of rocker stop elements, wherein the first of the end stop elements is disposed between the first pair of rocker stop elements, and the second of the end stop elements is disposed between the second pair of rocker stop elements.

8. A key module of a key for a keyboard comprising:

a key button; and a receiving section for receiving a key stem, wherein the key stem comprises a coupling section for coupling the key button and a guidance section that is received in the receiving section of the key module when they key stem is actuated between a standby position and an actuation position, and wherein the key stem comprises a material for the at least one end stop element having a lower hardness than a material for the guidance section, and a material for the at least one return stop element having a lower hardness than the material for the guidance section.

9. The key module according to claim 8, wherein the key stem further comprises at least one elastically deformable end stop element, which is disposed on the guidance section and is designed to bear against at least one end stop section of the key module when the key stem is actuated into the actuation position, and at least one elastically deformable return stop element, which is disposed in the guidance section and is designed to bear against at least one return top section of the key module when the key stem is actuated back to the standby position.

10. The key module according to claim 9, wherein the at least one end stop element has a rubber lip, and the at least one return stop element has a rubber lip.

11. The key module according to claim 9, wherein the at least one end stop element is disposed in a first end region of the guidance section, facing away from the coupling section, and the at least one return top element is disposed in a second end region of the guidance section, facing toward the coupling section.

12. The key module according to claim 9, wherein the key stem further comprises an actuation path for the key stem between the standby position and the actuation position, wherein the actuation path is a function of a thickness dimension of the at least one end stop element along an actuation axis of the key stem and a thickness dimension of the at least one return stop element along an actuation axis of the key stem.

13. The key module according to claim 9, wherein the key stem further comprises a plurality of elastically deformable rocker stop elements, which are disposed on the guidance section and designed to bear against the receiving section of the key module when the key stem is actuated into the actuation position with a tilting actuation of the key stem with respect to the key module.

14. A method for manufacturing a key module of a key for a keyboard, the method comprising:

providing a key module comprising a key button, a receiving section for receiving a key stem, at least one end stop section, and at least one return stop section, wherein the key stem comprises a coupling section for coupling the key button and a guidance section for guiding the key stem into the receiving section of the key module, at least one end stop element, and at least one return stop element, and wherein the key stem comprises a material for the at least one end stop element having a lower hardness than a material for the guidance section, and a material for the at least one return stop element having a lower hardness than the material for the guidance section; and positioning the guidance section of the key stem in the receiving section of the key module, such that the at least one end stop element of the key stem is disposed between the guidance section of the key stem and the at least one end stop section of the key module, and the at least one return stop element of the key stem is disposed between the guidance section of the key stem and the at least one return stop section of the key module.

15. The method according to claim 14, further comprising positioning the at least one end stop element against the at least one end stop section of the key module to actuate the key stem into an actuation position.

16. The method according to claim 14, further comprising positioning the at least one return stop element against the at least one return stop section of the key module to actuate the key stem into a standby position.

17. The method according to claim 14, wherein the key stem further comprises a plurality of elastically deformable rocker stop elements, which are disposed on the guidance section and designed to bear against the receiving section of the key module when the key stem is actuated into the actuation position with a tilting actuation of the key stem with respect to the key module.

18. The method according to claim 17, wherein the key stem further comprises two return stop elements, two end stop elements and two pairs of rocker stop elements, wherein the first of the end stop elements is disposed between the first pair of rocker stop elements, and the second of the end stop elements is disposed between the second pair of rocker stop elements.

* * * * *